US007883291B2

(12) United States Patent
Theisen et al.

(10) Patent No.: US 7,883,291 B2
(45) Date of Patent: Feb. 8, 2011

(54) MANDREL-WOUND FLOCCULANT-CONTAINING FIBER FILTRATION TUBES

(75) Inventors: Marc S. Theisen, Signal Mountain, TN (US); Kevin S. Spittle, Vero Beach, FL (US)

(73) Assignee: Profile Products L.L.C., Buffalo Grove, IL (US)

( * ) Notice: Subject to any disclaimer, the term of this patent is extended or adjusted under 35 U.S.C. 154(b) by 0 days.

(21) Appl. No.: 12/273,640

(22) Filed: Nov. 19, 2008

(65) Prior Publication Data

US 2009/0071596 A1 Mar. 19, 2009

Related U.S. Application Data

(63) Continuation of application No. 11/158,592, filed on Jun. 22, 2005, now abandoned.

(51) Int. Cl.
*B01D 39/00* (2006.01)
*E02B 11/00* (2006.01)

(52) U.S. Cl. ..... 405/43; 210/503; 405/36

(58) Field of Classification Search ..... 405/15, 405/16, 36, 43, 302.4, 302.6, 302.7; 210/203
See application file for complete search history.

(56) References Cited

U.S. PATENT DOCUMENTS

| | | | | |
|---|---|---|---|---|
| 2,757,150 | A | 7/1956 | Heritage | |
| 3,936,380 | A * | 2/1976 | Boske | 210/170.07 |
| 5,017,319 | A | 5/1991 | Sven | |
| 5,330,828 | A | 7/1994 | Jacobsen, Jr. et al. | |
| 5,402,445 | A | 3/1995 | Matsuura | |
| 5,484,501 | A | 1/1996 | Jacobsen, Jr. et al. | |
| 5,591,335 | A * | 1/1997 | Barboza et al. | 210/323.2 |
| 5,735,982 | A * | 4/1998 | Prunty et al. | 156/62.2 |
| 5,779,782 | A | 7/1998 | Spittle | |
| 6,360,478 | B1 | 3/2002 | Spittle | |
| 6,391,200 | B2 * | 5/2002 | Pulek et al. | 210/497.1 |
| 6,464,428 | B1 * | 10/2002 | Mikell | 405/15 |
| 6,729,807 | B1 * | 5/2004 | Spittle | 405/302.7 |
| 6,733,209 | B2 * | 5/2004 | Allard | 405/302.6 |
| 6,905,289 | B1 * | 6/2005 | Sanguinetti | 405/302.6 |
| 7,029,208 | B1 * | 4/2006 | Santha | 405/302.6 |
| 2002/0159845 | A1 * | 10/2002 | Mikell | 405/302.6 |
| 2002/0185456 | A1 * | 12/2002 | Ward et al. | 210/766 |
| 2003/0031511 | A1 | 2/2003 | Tyler | |
| 2005/0000583 | A1 * | 1/2005 | Masui et al. | 138/137 |
| 2005/0254899 | A1 | 11/2005 | Tyler | |

FOREIGN PATENT DOCUMENTS

| | | |
|---|---|---|
| EP | 0161766 | 11/1985 |
| EP | 0492016 | 7/1992 |

* cited by examiner

*Primary Examiner*—Tara Mayo-Pinnock
(74) *Attorney, Agent, or Firm*—Brooks Kushman P.C.

(57) ABSTRACT

Fiber filtration tubes containing flocculant are produced by winding a preformed mat of natural fibers about a mandrel. The tubes may be joined end to end to produce products of significant length, and are highly suitable in removing even very fine sediment during use in erosion control.

19 Claims, 3 Drawing Sheets

MANDREL-WOUND FLOCCULANT-CONTAINING FIBER FILTRATION TUBES

This is a continuation application of U.S. application Ser. No. 11/158,592 filed Jun. 22, 2005, priority to which is claimed under 35 U.S.C. §120.

BACKGROUND OF THE INVENTION

1. Field of the Invention

The present invention pertains to fiber filtration tubes for use in erosion and sediment control.

2. Background Art

Fiber mulch mats are in widespread use in preventing soil erosion and to aid in germination of seed beds. The fibers in such mats, also termed turf reinforcement mats ("TRM") may be derived from numerous organic sources, including wood fibers, straw, jute, sisal, coconut, and paper. Due to its ready availability, wood fibers are preferred for such products.

Fiber mulch mats must possess satisfactory physical characteristics which are often conflicting. For example, the mats should aid in water retention when used to aid seed germination, yet must be open enough to allow seedlings to penetrate the mat. The mats must also be of sufficient strength to be handled effectively during installation over soil and/or seedbeds, and must retain their integrity over extended periods while exposed to the elements. Otherwise, their ability to control run-off, and hence erosion, would be rapidly lost.

In the past, fiber mats have been bound together with the aid of numerous organic binders, both natural and synthetic. Natural binders include starches, vegetable gums, and the like, including chemically modified celluloses such as hydroxyethyl cellulose, hydroxypropyl cellulose, carboxymethyl cellulose, and the like. Such natural or chemically modified natural binders suffer from the defect of rapid degradation due to exposure and to the action of microorganisms. Synthetic polymeric binders such as styrene-butadiene latexes, polyacrylates, polyvinylacetate, polyvinylacetate-ethylene copolymers, phenolic resins, and the like have also been used. Such polymer-based binders are generally more expensive than natural binders, and many exhibit at least modest water swellability, which decreases the binding capability and hence strength of the product over time following installation.

In U.S. Pat. No. 5,779,782, binding of spray-applied fiber mulch mats is improved by the incorporation of crimped synthetic fibers which serve to entangle with other crimped synthetic fibers and natural fibers to increase the integrity of spray applied mats while employing less or no binder. In U.S. Pat. No. 6,360,478, it is proposed to employ permanently crimped natural fibers for a similar purpose. No preformed mats are disclosed, however, and the degree of entanglement of either natural or synthetic fibers, without the use of a binder, may not be sufficient to formulate a mat with adequate tear strength or tensile strength. In U.S. Pat. Nos. 5,779,782, 5,330,828 and 5,484,501, it is proposed to employ low melting organic polymer fibers together with natural mulch fibers. The mat is preferably air laid, and passes between heated embossing rollers which melt portions of the organic fibers, thus binding together the mulch fibers.

Control of surface runoff to prevent erosion has been practiced for millennia. Use of terraced hillsides for agriculture, and construction of low stone walls on hills and in ditches to trap sediment and reduce runoff are widely evident throughout the world. However, erosion control mats do not always work well alone on steep slopes, and are generally impractical to install over large areas. Moreover, areas where crops are being planted and grown must be kept free of such products. Finally, while the erosion control mats previously described can be effective to reduce water velocity and trap larger sediment to a degree, they are largely ineffective at trapping very fine particulates such as colloidal clay particles.

Recently, wattles have been employed to reduce water velocity of surface runoff and to trap sediment. These wattles are essentially mesh tubes filled with natural fibers such as rice straw, wheat straw, coconut, and wood excelsior fibers. The wattles or fiber rolls are placed at intervals across the slope, i.e. perpendicular to the direction of runoff, and are frequently used in conjunction with rolled erosion control products and hydraulic seeding techniques, as described in PCT/US04/14464, herein incorporated by reference.

When employed to trap fine sediment, such fiber rolls may also be termed "filtration tubes." However, tubes specifically designed to trap and flocculate fine sediment have not been commercially available; what "filtration" occurs has been incidental to commercial wattles or fiber rolls whose principle purpose is preventing washout, lowering the velocity of water runoff, and trapping large sediment particles. A disadvantage of conventional fiber rolls or wattles is their relatively high transportation cost, as their density is rather low, and as they can tolerate little compression to facilitate shipping. A further disadvantage is their limited lifespan. The natural fibers tend to degrade rather quickly, in most cases within a year or two. Use of rice straw, with its relatively high silica content, can extend the useful lifetime, claimed to be up to 3 to 5 years in the low humidity, semi-arid western North American environments. In addition to their use on sloped surfaces, filtration tubes can also be positioned in gullies, channels and ditches.

The sediment holding capacity and filtration capacity are related to numerous properties, including the geometric shape of the filtration tube, composition of the fill material and the fill density. A high fill density may result in more efficient capture of very fine particles such as those found in clay and clayey soils. However, the tradeoff is that such higher packing density both lowers the water filtration rate, which results in overflow under high rainfall conditions and may also causes the tubes to become plugged with sediment particles, losing much of their effectiveness, again resulting in overflow. Conventional straw fiber rolls also do not absorb water easily due to the high lignin content and shape of the rice straw fibers as well as the limited surface area per unit weight of such products. Washout of newly installed straw and wood excelsior fiber rolls can occur due to their light weight and inability to absorb large amounts of water. Colloidal particles, in general are very inefficiently trapped by all such products.

It would be desirable to provide a fiber filtration tube suitable for use in erosion control, particularly in applications where fine particles such as those present in clayey soils are present, which provide superior sediment retention capability, and which are effective even when high concentrations of fine sediment are present. It would be further desirable to provide an economical means of providing such fiber filtration tubes, particularly those of relatively long length.

SUMMARY OF THE INVENTION

The present invention pertains to fiber filtration tubes prepared by a process wherein a mat of natural fibers is wound around a non-removable mandrel or preferably, a removable mandrel, to form a fiber filtration tube in the form of a log. The fiber filtration tube further contains a flocculating agent which serves to flocculate fine particles. A very high degree of sediment control of all sediment sizes is thereby accomplished. Long fiber filtration tubes are fabricated by end-to-end adhesive bonding of shorter and more economically manufacturable fiber filtration tubes.

DETAILED DESCRIPTION OF THE PREFERRED EMBODIMENT(S)

Figure 1:
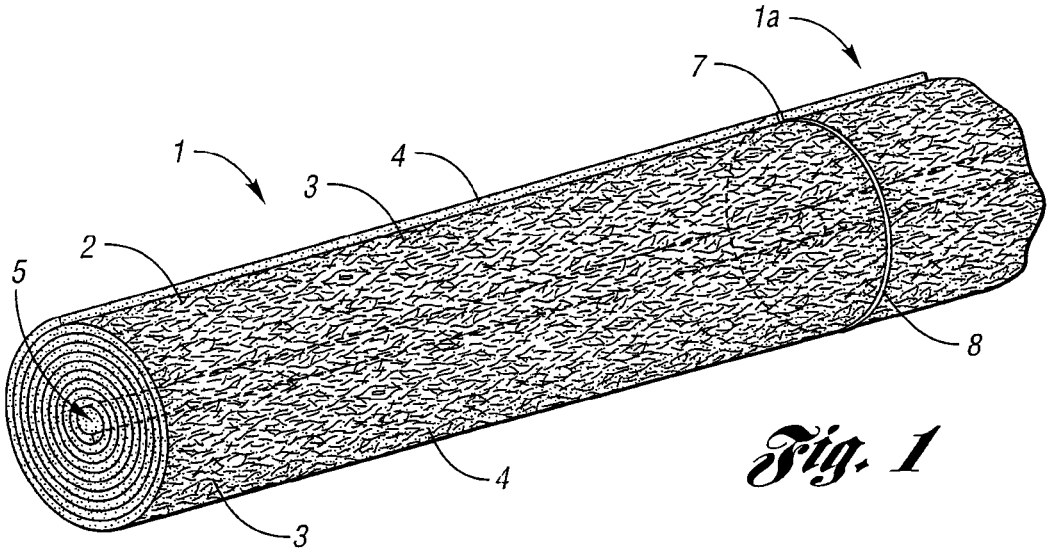
FIG. 1 illustrates one embodiment of a fiber filtration tube of the invention, prepared by winding around a removable mandrel.

The subject invention filtration tubes have differing utilities as compared with existing fiber roll products. The ability of filtration tubes to capture and flocculate suspended matter allows them to be used in additional applications such as placement around storm water drains, drainage inlets, and gutters. In addition, their absorptive capabilities make them attractive for use in spill containment from industrial, commercial, medical and other markets.

The filtration tubes can be placed in surface storm water runoff instead of said flocculant blocks. The filtration tubes may provide a more flexible, more adaptable and more efficient flocculant delivery system. The increased flexibility of filtration tubes is thus an advantage over the rigid block or brick-like molded flocculant compositions, and they may be more strategically deployed in surface storm water flocculating systems.

In a preferred embodiment, fiber filtration tubes are produced from substantially planar mats. Fibers are laid down by an air or water lay process, most preferably an air lay process, and formed into a mat. The mat is then rolled into a roll or "log" around a mandrel, which may be subsequently removed. Flocculant particles are sprinkled onto the mat prior to its being rolled, such that the flocculant preferably is on the side of the mat which faces the inside of the roll. it may be desirable to cease adding flocculant onto the last portion of the mat which will form the outermost circumferential layer of the roll, for the purpose of further ensuring minimal loss of flocculant through the relatively low density mat during shipping, handling, and installation. However, in practice, this additional precaution has not been found necessary.

The mat is preferably manufactured from air layed wood fibers and a minor portion of bicomponent fibers. The mat is heated and passed through calendering rollers or an equivalent device, bonding the mat through the softened or molten polymer which constitutes the lower melting polymer of the two polymers of the bicomponent fibers. In lieu of heating the mat, the rollers may be heated, or a combination of heated mat and heated rollers may be used. In a slightly less preferred embodiment, a suitable single polymer thermoplastic fiber such as polyethylene or polypropylene may be used. Further preferred embodiments employ thermoplastic fibers which are biodegradable, and embodiments which employ non-fibrous binders including adhesive resin latexes, adhesive resin powders, and naturally occurring adhesives such as starches, gums, etc. Combinations of all binders may of course be used, and as the fiber filtration tubes are of multiple layers and are generally tied at intervals, stapled, or, in particular, encompassed within a polymer netting, lesser amounts of binding fibers, binding adhesives, etc., may be used. It is even possible to provide a product without any binder, provided that the mat has sufficient integrity to be rolled. Fiber entanglement methods such as needling with barbed needles may be used to increase the integrity in this respect, particularly when wood or other fibers of somewhat longer length are used.

When polymer binding fibers, either normal fibers or bicomponent fibers, are used, the mat may be consolidated by heating to the softening point of the binding thermoplastic or higher, i.e. to the melting point or above followed by compression to contact the natural fibers with the softened or molten thermoplastic. Compression is preferably achieved between calendering rolls, pinch rolls, or by other means such as double band presses, and the like. However, consolidation is preferably achieved through use of heated rollers which both heat as well as consolidate. These rollers preferably have no embossing pattern.

As indicated, the fiber mat which is wound about the mandrel to form the fiber filtration tubes of the present invention may be prepared by any suitable method so long as the integrity, i.e. strength, tear resistance, etc., allows the mat to be wound about the mandrel, preferably by automated or semi-automated winding methods. Thus, for example, the mat may be prepared as disclosed in U.S. Pat. Nos. 5,779,782; 5,330,828; 5,484,501; or 6,360,478, or by any other method of forming and, if necessary, consolidating, the fiber mat. The mats may be described as generally or substantially planar, and preferably have a thickness ranging from 1 mm to 25 mm, more preferably 2 to 15 mm, and yet more preferably, 3 mm to 10 mm. The integrity of the mats need not be the same as erosion control mats ("ECM") or turf reinforcement mats ("TRM"), although they may have the same degree of integrity or higher integrity. ECM and TRM products must exhibit a commercially acceptable degree of integrity for purposes of handling, shipping, installing, and for resisting the effects of the elements following installation. Due both to the fact that the subject invention fiber filtration tubes comprise numerous layers of wound mat as well as, in preferred configurations, the presence of a constraining net or other securing device on the outside of the tube, the physical property requirements of the net used to prepare the fiber filtration tubes is generally not as critical. Using a mat containing less binder, or manufactured by simplified processes, is an economical advantage. It is preferred that the fiber mulch mats of he present invention comprise in excess of 50% by weight of natural fibers, preferably in excess of 60% by weight, more preferably from 70 to 95% by weight, and most preferably from 80 to 92% by weight. The mulch mats preferably also contain synthetic fibers, preferably in an amount of about 3% to about 30% by weight, more preferably from 5 to 25% by weight, and most preferably from 5-20% by weight. The nature of the synthetic fibers will be discussed in detail hereafter. At least a portion of the synthetic fibers are preferred to be bicomponent fibers. The mulch mats may also contain natural and/or synthetic binders, water absorbents, dyes and/or pigments, fertilizers, etc. It is currently preferred that the mat product contain 90% by weight wood fibers and 10% by weight synthetic fibers.

The preferred natural fibers are wood fibers, preferably with mean (number average) lengths of from 0.125 inch (ca. 2 mm) to 1 inch (25 mm), more preferably 0.25 inch (6 mm) to ¾ inch (19 mm). However, suitable natural fibers include any available or which can be made available in the requisite lengths, advantageously with an aspect ratio greater than 5, preferably with an aspect ratio of at least 10, more preferably at least 15, and most preferably at least 20. Suitable fibers include fibers of coniferous and deciduous woods, cotton, wool, flax, jute, coconut, hemp, straw, grass, and other fibers available directly from natural sources, as well as chemically modified natural fibers, for example chemically modified cellulose fibers, cotton fibers, etc. Suitable natural fibers also include abaca, cantala, caroa, henequen, istle, Mauritius, phormium, bowstring, sisal, kenaf, ramie, roselle, sunn, cadillo, kapok, broom root, coir, crin vegetal, and piassaua. These lists of natural fibers are illustrative and not limiting. Examples of chemically modified fibers also include azlon (regenerated natural proteins), regenerated cellulose products including cellulose xanthate (rayon), cellulose acetate, cellulose triacetate, cellulose nitrate, alginate fibers, casein-based fibers, and the like.

The natural fibers may be prepared by any convenient manner, for example as disclosed for wood fibers in U.S. Pat. No. 2,757,150, herein incorporated by reference, in which wood chips are fed to a pressurized steam vessel which softens the chips. Any type of wood chip may be used, but wood chips of the soft hardwood varieties, such as yellow poplar and particularly, softwoods such as pine, are preferred. A defiberator mechanically separates and sizes the chips into individual fiber bundles. The fibers are generally classified prior to use. The use of thermo-mechanical wood fibers yields several advantages. First, the refined wood fibers are highly hygroscopic in nature and allow the mat to absorb moisture immediately upon contact with water, unlike wood products such as excelsior, which may also be used however. Use of thermo-mechanical wood fibers thus results in reduced water run-off on a project site which improves percolation into the soil surface and minimizes erosion. Secondly, thermo-mechanical wood fibers are of a fine denier, and are shorter in length. This allows for a more supple mat product and also for the formation of a more uniform mat in both thickness and density. When the filtration tube prepared from these mat products is wet, it conforms much better to irregular terrain, which assists in eliminating the gap between the bottom surface of the tube and the soil. The ability to conform to the terrain acts to trap the soil which results in much less sediment loss. Thirdly, the wood fibers tend to entangle with thermoplastic fibers within the mat substrate, adding to the mat's strength in all directions, and thereby improving the handability of the fiber filtration tube product without requiring internal netting.

The natural fibers may also include crimped natural fibers, preferably permanently crimped natural fibers as disclosed in U.S. Pat. No. 6,360,478, herein incorporated by reference. The natural fibers preferably are not simply mechanically crimped, as purely mechanical crimping, for example between partially intermeshing toothed rollers, creates a crimped product which is incapable of retaining the necessary set following application, particularly in high humidity or wet (i.e., rain) environments. Rather, it is preferable that crimping be performed at a temperature which is such to cause thermal (i.e., plasticization) or chemical (i.e., crosslinking or degradation into adhesive-like decomposition products) changes which cause the crimp to be maintained even in the presence of light and moisture. In some cases, the fibers may be treated with a coating or impregnant which allows the fibers to retain their set without modification of the fibers per se. Examples of such coatings are methylolurea resins, phenol formaldehyde resins, melamine formaldehyde resins, urea formaldehyde resins, furfural-derived resins, and the like. Many of these resins are commercially available, and are used as binders, for example in fiberglass products, or in fabric treatment to bestow anti-wrinkle performance. In the present case, the coatings are applied and cured before, during, or after the crimping operation, to make permanently crimped fibers as opposed to their normal use in keeping fibers straight (i.e., in wrinkle free fabrics). These resins, due to their thin coating and chemical content, are themselves biodegradable. Some of the resins perform a fertilizing function as they degrade over time, i.e., melamine-formaldehyde, urea-formaldehyde and urea-melamine-formaldehyde resins. Other resins, e.g., epoxy resins, novolac resins, etc., may also be used. However, they are, in general, less biodegradable than the resins previously identified, as well as being more expensive.

Thus, when crimped natural fibers are desired, the fibers may be heat and/or steam treated, or may be crimped prior to cure of a curable coating and/or impregnant, or may employ a combination of such techniques, to create a permanently crimped fiber. Chemically modified natural fibers such as cellulose acetate cellulose triacetate, and cellulose nitrate may be crimped at, above, or near their softening point. Unmodified lignocellulosic fibers such as cotton, flax, wool, etc., must in general be heated to relatively high temperatures, often in the presence of moisture (i.e., superheated steam) to, for a time sufficient to partially break down some of the lignocellulosic or proteinaceous components.

Wood fibers, for example, and those of jute and coconut, may be heated in a moist atmosphere to a temperature and for a time where the fibers turn from golden brown to dark brown and are then crimped. Under these conditions, a natural adhesive is formed as a degradation product, as taught by U.S. Pat. No. 5,017,319 and European Patents EP 0 161 766 and EP 492 016, herein incorporated by reference. Fibers crimped in this condition and then cooled, will have a set which allows the crimps to be maintained over an extended period of time, even in the presence of moisture.

The crimping conditions vary with each type of fiber, its source, and its method of preparation. Finding suitable crimping conditions is straightforward, however, and involves, for natural fibers without coatings, passing the fibers through crimping devices at various temperature and moisture levels, and testing for permanent crimp by exposing the crimped fibers to a warm, high, humidity environment. For example, the fibers may be placed in a metal tray in an environmentally controlled oven and periodically sprayed with a mist of water. Fibers which maintain their ability to interlock following such exposure have been treated successfully, assuming the mulch product containing these crimped fibers is to be dry-applied. For mulch products to be applied from mulch tanks, the fibers should be first immersed in water and agitated 15 minutes prior to testing as above.

When a coating and/or impregnant is used, the fibers may be crimped mechanically and then sprayed with a solution or dispersion of the coating/impregnant material, or may be first contacted with the solution or dispersion and then crimped. In either case, the crimping and coating operations must be consolidated such that a crimped product containing a coating or impregnated with a cured resin is obtained. For example, crimped fibers may be transported by hot air through a conduit into which a mist of phenol/formaldehyde resin is introduced, the temperature, air flow and turbulence being such that the resin substantially cures without excessive agglomeration of fibers. Alternatively, fibers may be transported on a belt or other transportation device in an uncrimped state, sprayed with curable resin and dried at a temperature insufficient to cause the resin to cure. The fibers, now coated with dry, curable resin, are then crimped at a higher temperature at which the resin cures. Alternatively, the coated fibers are crimped at a low temperature at which the resin does not cure, and are subsequently cured in a heated chamber or conduit. Fibers which become partially agglomerated in any of these processes may be mechanically separated, preferably immediately after curing of the resin, or during resin cure. It is preferable that less than 20 weight percent of all natural fibers are permanently crimped natural fibers, more preferably less than 10 weight percent, and yet more preferably less than 5 weight percent.

The natural fibers may also include waste from textile processes where cloth, yarn, or thread of cotton, linen, wool, silk, etc., are used. Paper fibers and flakes may also constitute a portion of the total natural fiber, preferably not more than 30% by weight, more preferably less than 10% by weight, yet more preferably less than 5% by weight. It is preferable that 80-100%, more preferably 90-100% of the natural fibers be wood fibers. In lieu of a large percentage of wood fibers, it is preferable that the natural fibers comprise wood fibers admixed with inexpensive natural fibers such as flax, sisal, jute, hemp, coconut, grass, straw, and the like. The most preferred natural fibers are conventional, non-crimped fibers, preferably wood fibers.

The synthetic fibers may comprise bicomponent fibers having a high melt temperature core and a low melt temperature sheath. It is preferable that the core be polyester and the sheath be polyolefin, preferably polyethylene or polypropylene (including copolymeric polyethylene polymers and polypropylene polymers), and most preferably polypropylene homo- or co-polymers. While the terms "core" and "sheath" are used to describe the bicomponent fibers herein, these terms also include bicomponent fibers having an incomplete sheath, including bicomponent fibers where a strand of high melt temperature polymer abuts, continuously or discontinuously, a strand of low melt temperature polymer. The important consideration is that the bicomponent fiber be an integral fiber containing both polymers, regardless of physical arrangement, so long as the low temperature polymer is not completely surrounded or obscured by the high temperature polymer. By the term "high melt temperature" is meant a melt temperature such that the core of the fiber does not melt and thus lose its integrity under mat consolidation conditions. Some softening of the core is allowable. By "low melt temperature" is meant a temperature at which the sheath polymer softens and/or melts to the degree necessary to bind the natural fibers and other constituents of the mat together. The preferred bicomponent fibers are bicomponent fibers available from Leigh Fibers, having a low temperature sheath melting at about 110° C., and a core which melts at 500° F. (260° C.) or higher. However, other bicomponent fibers are commercially available and useful as well.

Core/sheath bicomponent fibers may be supplied with a concentric or eccentric core; the latter, as well as non-core/sheath bicomponent fibers, e.g. those having a side-by-side morphology, are useful in providing a product with greater loft while employing the same amounts of raw materials. Bicomponent fibers with polyester core and sheaths of polyethylene, linear low density polyethylene, and copolyester are available, as are also bicomponent fibers with a polypropylene core and polyethylene sheath. Bicomponent fibers with a polyamide core are also available. Copolyester sheaths generally have melting points in the range of 130° C. to 220° C., while polyethylene sheaths range from about 90° C. to 130° C. Polypropylene in core products generally melts at about 175° C., while polyester cores may melt from 200° C. to 250° C. or higher. Bicomponent polyamide fibers are also available with a polyamide 6,6 core (m.p. 260° C.) and polyamide 6 sheath (m.p. 220° C.). Core/sheath ratios of bicomponent fibers may range from 20:80 to 80:20 by weight, more preferably 60:40 to 40:60, and generally about 50:50.

The melting point of a sheath polymer or core polymer is dependent, of course, on its chemical makeup, and partially dependent on its molecular weight. Thus, lower molecular weight and to some degree oligomeric products tend to have lower melting points, while incorporation of comonomers, such as 1-butene and 1-octene in polyethylene, generally also lower the melting point. For "homopolyesters," polyethyleneterephthalate (PET) has a lower melting point than polyethylenenaphthalate (PEN). Many combinations are possible, and commercially available. Bicomponent fibers are also available from Fiber Innovation Technology, Inc., Johnson City, Ind., and ES Fibervisions, Inc., Athens, Ga. The bicomponent fibers comprise minimally 5 weight percent of the total weight of all synthetic fibers, preferably minimally 10 weight percent, more preferably minimally 15 weight percent, and may comprise any weight percentage up to 100 weight percent of total synthetic fibers, each percentage between 5 weight percent and 100 weight percent considered herein as individually disclosed. It is particularly preferred that the bicomponent fibers comprise from 60-100% of the total synthetic fiber content, more preferably 70-100%, yet more preferably 80-100%, and most preferably 90-100%. Most particularly, all synthetic fibers are bicomponent fibers.

The synthetic fiber component may also comprise conventional synthetic fibers other than bicomponent fibers. Such fibers may include fibers of relatively low melt temperature, i.e., which will soften appreciably and/or melt under mat consolidation temperatures, and those of relatively high melt temperature, i.e., which will remain integral under mat consolidation conditions. The terms "relatively" low and "relatively" high are used to describe the melt temperatures of the non-bicomponent fibers, since melting of these fibers is dependent upon the mat consolidation temperature which is in turn dependent upon the melting point of the low melt temperature portion of the bicomponent fibers. A "relatively low" melt temperature fiber will exhibit at least some appreciable softening and/or melting during consolidation, while "relatively high" melt temperature fibers will exhibit substantially no melting. Thus, the relatively low melt temperature fibers may assist in mat bonding, with greater assistance in this respect as the consolidation temperature increases, while relatively high temperature fibers generally produce no increase in binding, but an increase in tensile strength of the mat due to these fibers retaining their integrity during consolidation.

Relatively low melt temperature fibers are preferably polyolefin homopolymers and copolymers, for example polyethylene fibers and polypropylene fibers, which are preferred. The relatively low melt synthetic fibers may comprise the remainder of the non-bicomponent fibers, but preferably constitute no more than 95% by weight of the total synthetic fiber content, more preferably less than 90% by weight, and most preferably about 85% by weight when both bicomponent and non-bicomponent fibers are employed.

Relatively high melt temperature fibers include high density polyethylene fibers, polyester fibers, polycarbonate fibers, polyamide fibers, rayon fibers, polyvinylalcohol fibers, polyvinylacetate fibers, polyacrylonitrile fibers, carbon fibers, and the like. Preferably, the relatively high melt temperature fibers are polyester fibers, particularly polyethylene terephthalate fibers, or polyamide fibers. The fibers may be virgin fibers, fibers obtained as recyclable products from textile and/or carpet manufacture, or any other source. The relatively high melt temperature fibers may be crimped, as disclosed in U.S. Pat. No. 5,779,782, herein incorporated by reference. The high melt temperature fibers may comprise up to 80 weight percent of total synthetic fibers, more preferably up to 60 weight percent, and most preferably from 0 weight percent to 50 weight percent, with each percentage from 0 weight percent to 80 weight percent considered as individually disclosed herein.

The synthetic fibers other than bicomponent fibers may have a denier of preferably from 2 to 64, more preferably 4 to 32 denier. Relatively high melt temperature synthetic fibers may range in length from ¼ inch (6 mm) to a length which is still practical for lay up of the mulch mat, e.g., up to about 8 inches (20 cm) in length, preferably no longer than about 4 inches (10 cm), and most preferably in the range of 1 inch (2.5 cm) to 3 inches (7.6 cm). Lengths of 2 to 3 inches (5.0 to 7.6 cm) have been found to be most useful. A mixture of fiber lengths may be used. Such mixtures are particularly useful when some long fibers, i.e., those between 4 inches (10 cm) and 8 inches (20 cm) are employed. A mixture of 10% by weight of fibers having lengths from 2 to 3 inches (50-76 mm) and 90% by weight in the range of ¼ inch (6 mm) to ¾ inch (19 mm) may be especially useful, as the longer fibers will aid in imparting greater tensile strength and tear strength, yet will be present in amounts such that traditional air- or water-laying fabrication techniques can be used. Preferably, the relatively high melt temperature synthetic fibers have lengths between ¼ inch (6 mm) and ¾ inch (19 mm).

The relatively low melt temperature fiber length is not as important as that of the high melt temperature fibers, as these fibers partially or substantially melt during the mat consolidation process. For purposes of ease of fabrication, it is desirable to avoid low melt temperature fibers of greater than 2 to 3 inches (25 mm-75 mm) length, as fabrication may be rendered more difficult. Preferred fiber lengths are as low as ⅛ inch (2 mm) or lower, particularly when the entire mat surface is to be melt-consolidated, but preferably range from ¼ inch (6 mm) to 3 inches (19 mm) in length, more preferably 1 to 2 inches (25 mm to 50 mm). However, much longer fibers of all types can be used so long as they can be processed into a mat product.

The bicomponent fibers are preferably supplied in lengths similar to those of the high melt temperature conventional synthetic fibers, and at deniers of from 2 to 64, preferably 4 to 32. Bicomponent fiber lengths of 2 to 3 inches (5.0 to 7.6 cm) with a denier of about 15 are particularly suitable.

Non-filamentary binders may be present in amounts of up to 20 percent by weight relative to the total weight of the mulch mat, preferably up to 10 percent by weight, and more preferably in the range of 0 to 5 percent by weight, each percentage between 0 and 20 being considered distinctly disclosed herein. By the term, "non-filamentary binders" is meant traditional powders or dispersions of natural or synthetic gums, resins, and the like which have heretofore been used in binding mat products, or which may be used in the future for such purposes. Preferably, non-filamentary binders are absent.

Preferred non-filamentary binders, when used, include starches such as corn starch, naturally occurring gums such as guar gum, gum tragacanth, and the like, and modified celluloses such as hydroxyalkyl celluloses and carboxyalkyl celluloses. Synthetic binders include a variety of polymers, particularly addition polymers produced by emulsion polymerization and used in the form of aqueous dispersions or as spray dried powders. Examples include styrene-butadiene polymers, styrene-acrylate polymers, polyvinylacetate polymers, polyvinylacetate-ethylene (EVA) polymers, polyvinylalcohol polymers, polyacrylate polymers, polyacrylic acid polymers, and the like. Powdered polyethylene and polypropylene may also be used. When used, synthetic binders are preferably used in aqueous form, for example as solutions, emulsions, or dispersions.

Thermoset binders may also be used, including a wide variety of resole and novolac-type resins which are phenol/formaldehyde condensates, melamine/formaldehyde condensates, urea/formaldehyde condensates, and the like. Most of these are supplied in the form of aqueous solutions, emulsions, or dispersions, and are generally commercially available. Melamine/formaldehyde, urea/formaldehyde, urea/melamine/formaldehyde and like condensates may also serve as a slow release nitrogenous fertilizer. Adhesive binders of the types described in this and the preceding paragraph may be used instead of or in conjunction with other binders such as the fibrous binders earlier described.

The various ingredients may be premixed or supplied in the form of their individual components, by methods well known to those skilled in the art, for example by distribution in air followed by collection on a belt or foraminous screen. Methods of fabrication are disclosed in U.S. Pat. Nos. 5,330,828 and 5,302,445, which are herein incorporated by reference. The constituents may be deposited by water-laying methods as well, as in paper making machines, particularly when water soluble ingredients are avoided. Water-laying is particularly suitable when water soluble or dispersible binders are employed. These binders may also be sprayed onto an as-layered mat, or sprayed into the air stream conveying fiber components when air-laying is used. Once laid into a mat, the fibers may be carded, crosslapped, stitched, needled, or otherwise treated by conventional techniques used with non-woven materials.

Following preparation of the "as-layed" mat, the mat must generally be further consolidated by heating to a temperature where the low melt temperature sheath polymer of any binding fibers melt and bind the fibers together. Heating is generally conducted by infrared heating, for example using commercially available radiant panels, to a temperature sufficient to soften and/or fuse the low melting polymer sheath of the bicomponent fibers. Consolidation may also take place at modest pressure between heated rollers, as disclosed in U.S. Pat. Nos. 5,402,445 and 5,484,501, herein incorporated by reference. The gap between the rollers or "rolls" is adjusted to supply the desired amount of pressure and compaction, and is clearly dependent upon the initial unconsolidated mat thickness and the end product thickness desired. For example, for an initial unconsolidated thickness of form 0.5 inch (1.27 cm) to 0.75 inch (1.91 cm) thickness, a roll spacing of from 0.6 to 1.5 mm, preferably 0.7 mm to 1 mm may be used. It is preferable, however, that radiant heating be used to soften or fuse the low melting polymers, followed by compression between rollers maintained at a lower temperature. It is also possible to use other methods of consolidation, for example platens or continuous belts such as those supplied by Sandvik. The mats generally reexpand following consolidation, although in most cases, not to their preconsolidation thickness.

The mats may also be embossed during consolidation. Embossing takes place generally between pressured rollers or nips, at least one which has a pattern on the surface thereof, preferably at a point where the consolidating thermoplastic fibers are still in a softened or fused state. The embossing rolls and the process of embossing are as described in U.S. Pat. No. 5,330,828, herein incorporated by reference. The embossing/consolidation temperature is selected such that the bicomponent fiber sheaths melt to consolidate the mat, and low melt temperature synthetic fibers, if included, as least partially melt as well, but at a temperature where the core polymers of the bicomponent fibers and high melt temperature conventional fibers do not melt, or do not melt to the degree that their strength imparting properties are lost. This temperature may be achieved by preheating the mat, i.e. in an oven or with infrared energy, or by heated consolidation rollers or any combination, so long as the low temperature polymers, whether contained in conventional or bicomponent fibers, melt to the degree necessary to bind the mat constituents. It is preferred not to emboss the mat.

Synthetic polymer flocculants are preferred, and these are well known to those skilled in the art of aqueous particulate sedimentation. Preferred polymers are homo and copolymers of polar and generally ionizable unsaturated monomers such as acrylamide, N-methylolacrylamide, N-hydroxypropylacrylamide, acrylic acid, methacrylic acid, acrylate esters, maleic and fumaric acids, maleic anhydride, vinyl fulonates, and the like. Non-functional monomers such as alkyl acrylates, olefins, etc., may also be copolymerized. The exact makeup of the polymer is unimportant as long as it has sufficient solubility to serve its flocculant function and limited solubility such that its effects will persist for long periods of time during use. In general, the polymers are substantially linear polymers, as crosslinking renders the polymers swellable but insoluble. Such polymers can act as water absorbants, but not as flocculants. Preferred flocculants are linear polyacrylamide homopolymers and copolymers. A particularly preferred flocculant is Polyacrylamide Viscous, available from JRM Chemical.

As indicated previously, the flocculant is preferably sprinkled or cast onto the fiber mat prior to the mat being rolled into the filtration tube. The flocculant is normally dry and is applied in a dry state. Since the particle size of the flocculant will affect the dissolution rate, the particles preferably have a relatively wide particle size distribution, although uniformly sized particles with a very narrow particle size distribution may also be used, as well as bimodal and multi-modal distributions. A particle size distribution which has been proven effective in actual tests has the distribution set forth below in Table 1, in percentage by weight.

TABLE 1

| % by weight | Particle size minimum | Particle size maximum |
|---|---|---|
| 29.85 | >850 μm | <2000 μm |
| 47.10 | >425 μm | <850 μm |
| 15.80 | >250 μm | <425 μm |
| 5.30 | >180 μm | <250 μm |
| 1.90 | >150 μm | <180 μm |
| 0.05 | >1 μm | <180 μm |

Of course, any alternative method of providing flocculent to the filtration tube can be used. For example, dry flocculent can be delivered in a mist of water or a water spray to add adhesive character to the flocculant particles, or the web may be sprayed for the same purpose. For flocculants of sufficient molecular weight so as to be spinnable, the flocculant may be extruded into fibers or strands, which can be applied to the roll in numerous forms, for example as a net, as continuous fibers or strands, or as chopped fibers, strands, yarns, etc. When spun flocculant is used, the fibers or strands preferably are spun in a variety of diameters, and hence deniers, so as to provide a range of soluble species sizes, much in the same way as a broad particle size distribution is preferred for flocculant particles.

Flocculant may also be sprayed in molten form onto the mat, as strands, globules, or the like. For such purposes devices such as spinnerettes, rotating cones, simple pressure spray heads, and the like may all be used. It is even possible for flocculant to be injected into the otherwise finished filtration tube by large size hollow "needles." Whichever method is used, it is preferable that a relatively uniform distribution of flocculant be obtained, both throughout the cross-section of the roll as well as along the length of the roll. If an asymmetric distribution is selected, it is preferable that the major portion of flocculent, i.e. its greatest concentration, be below the midline of a cross-section of the fiber filtration tube. In such cases, however, it may be necessary to mark the filtration tube to distinguish the bottom surface which should contact the ground, from the other surfaces. For this purpose, the bottom or top of the roll may be sprayed with a suitable marking paint, or may be otherwise identified.

While it is possible to manufacture mat products in very long lengths, the width of such products will be limited by the size of the machinery employed. For example, air laying equipment and associated carders, openers, etc., are commonly available moderate widths, i.e. 8 foot (2.4-2.5 m) widths. However, as the width increases, the machinery becomes increasingly heavy, becomes increasingly difficult to design and maintain, and becomes increasingly expensive as well. Since fiber filtration tubes are desired to be provided in long lengths, i.e. in some cases in excess of 30 feet (9 m) long, a tube made of a single mat would require a mat of width identical to the filtration tube length, e.g. 20 to 30 feet.

In order to enable conventional machinery to be employed, it has been found that long filtration tubes may be prepared by adhesively bonding fiber filtration tube precursors of shorter length, end-to-end. Thus, in a typical process, a 6.5 foot (2 m) mat is produced conventionally from wood fibers and polymer fibers and/or binder, sprinkled with flocculent particles as the mat is rolled around a mandrel, and inserted into a long tube, for example of steel or release coated steel, i.e. with a polypropylene or Teflon inner surface. The roll may be made to any desired diameter, e.g. preferably from about 6 inches (15 cm) to 20 inches (50 cm). At the far end of the tube is a netting apparatus which supplies a tight fitting polymer netting sheath as the filtration tube is pushed through the tube and out the far end. After the 8 foot (2.4 m) section is completely within the tube, a fast setting adhesive, for example a hot melt adhesive, is applied to the end of the resident fiber roll, or to the facing end of a subsequent fiber roll which will enter the tube, or to both the end of the resident fiber roll and the subsequent fiber roll. Any means of adhesive application may be used, including brushing, spraying, extruding, roll coating, etc. The subsequent fiber roll then enters the assembly tube where the ends of the subsequent roll and resident roll abut and become adhesively bound. The adhesively bonded composite roll is then pushed down the tube, exiting at the far end while being surrounded by netting, or alternatively, by some other wrapping means. This process is repeated until the desired length is obtained. If the roll is not manufactured such that the desired length is automatically obtained, the roll can be cut or sliced to proper length at the takeoff end of the assembly tube. The fiber netting or other securing wrap is then suitably tied off, crimped, etc. to complete the filtration tube.

Although end to end (butt) bonding generally provides a low strength joint in virtually all adhesive bonding applications due to the low surface area of the bond; and although this defect of butt bonding would be expected to be extremely severe in fiber rolls where the end of the roll is not necessarily flat and fibers can be dislodged relatively easily, nevertheless, in the present application, this type of bonding has been found to be exceptionally strong, rolls preferring to tear under tensile forces at locations other than the adhesively bonded joints. Preferred adhesives are Reynco 51-942 and Reynco 53-808A synthetic hot melt adhesives, the latter providing a faster setting time and stronger bond, while the former sets somewhat slower and is somewhat more tacky. Both adhesives cool to a water resistant thermoplastic, and have a viscosity of 3000 to 4000 cps during application.

Preferred wood fibers are softwood fibers of pine, which tend to provide somewhat longer and thinner fibers than other varieties. However, hardwood fibers as well as other softwood fibers are also suitable, as are also a variety of natural fibers mentioned elsewhere herein, i.e. jute, sisal, cotton, flax, etc., either alone, or preferably, with the wood fibers. The most preferred wood fibers are pine, with the following classifier specifications on a Rotap sieve shaker, 5 minute duration (Table 2). All percentages are in weight percent:

TABLE 2

| Sieve Mesh Size | Preferred Range |
|---|---|
| #8 | 32.5-40.0 |
| #16 | 17.5-25.0 |
| #24 | 11.0-19.0 |
| #50 | 7.0-15.0 |
| #100 | 4.0-10.0 |
| Pan(<#100) | 10.0 |

The preferred binding fibers are 15 denier bicomponent fibers, at about 10 weight percent bicomponent fibers and 90 weight percent wood fibers.

The filtration tubes are most preferably encased in a polymer netting sheath which closely abuts the tube per se. Such sheaths may be supplied in numerous forms, and may even be woven around the tube by multi-directional knitting machinery. However, it is preferred that the netting be supplied in tubular form, i.e. in a continuous roll, and "bunched" over the exit of the forming tube, thus encompassing the filtration tube as it exits the forming tube. The net is generally secured at the leading end of the filtration tube prior to or shortly after its exit from the forming tube, and is also secured after the trailing end exits the tube or is cut to length. A preferred polymer netting is Tipper Tie Net-All available from Tipper Tie, Inc. Other means of securing the wound filtration tubes, such as tying with string, rope, cord, etc., stapling, or adhesively bonding the last layer or last two layers are also suitable. The ends of the polymer netting may be left open, if desired, although this is not preferred.

In use, the fiber filtration tubes are stretched across steep hillsides, in gullies, depressions, etc., where runoff is expected. Due to the construction of the fiber filtration tubes of the present invention, the filtration tubes are highly flexible, which provides advantages not only during shipping and handling, but also during installation. Much of this increased flexibility is due to the presence of a hollow in the center of preferred filtration tubes, this hollow formerly occupied by the mandrel around which the planar mat product is rolled to form the filtration tube, the mandrel being later removed.

Further advantages of the inventive fiber filtration tubes are due to the high surface area of the natural fibers used in their construction and their water absorption ability, which is high as compared to coarser "fillers" used in conventional tubes such as straw, particularly rice straw. A most important advantage, however, is the presence of flocculent, which provides a much more highly clarified filtrate, which is observable to the eye as well as measurable by standard turbidity measurements (nephalometry). While competitive products often become wetted over their lower portions only, the inventive filtration tubes become wetted over virtually their entire cross-section under similar conditions. Once again, the high effectiveness of the filtration tubes of the present invention is clear.

One embodiment of a fiber filtration tube of the present invention is shown in FIG. 1. In FIG. 1, filtration tube 1 is constructed by spirally winding layers of mat 2 of wood fibers 3 and containing flocculant particles 4 around a removable mandrel which, following removal, leaves an empty portion 5. A similar filtration tube 1*a* has been joined to tube 1 at butt joint 7 by means of adhesive 8.

Figure 2:
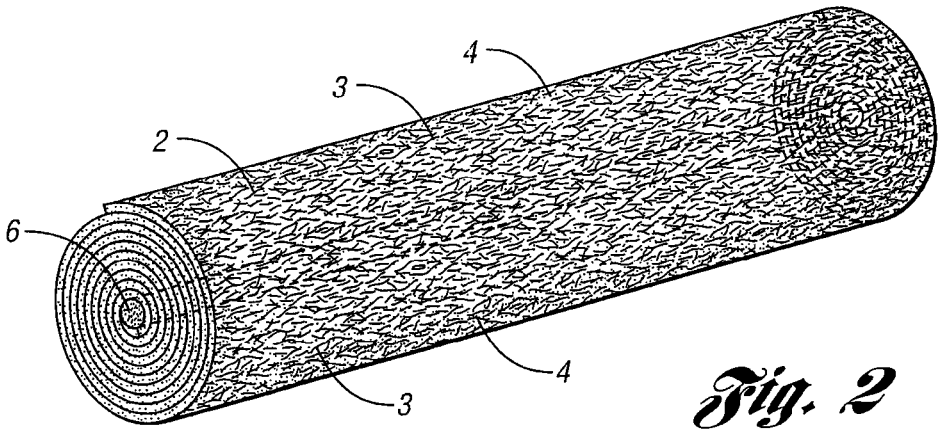
FIG. 2 illustrates another embodiment of a fiber filtration tube, prepared by winding around a non-removable mandrel.
Figure 3A:
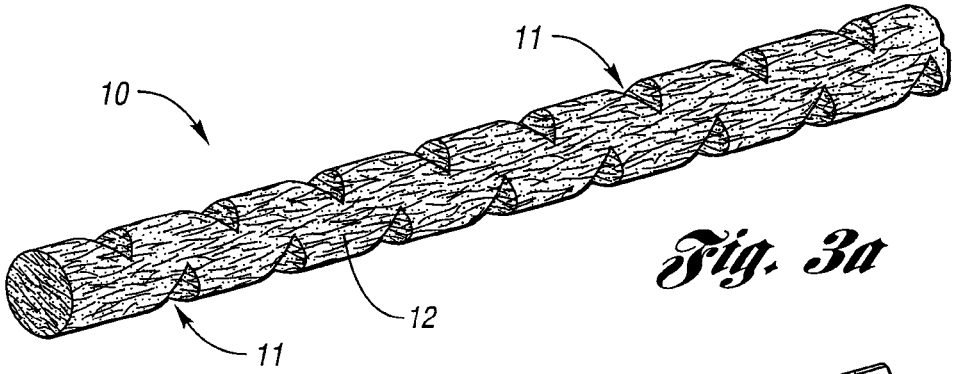
FIGS. 3*a* and 3*b* illustrate two embodiments of non-removable mandrels.
Figure 3B:
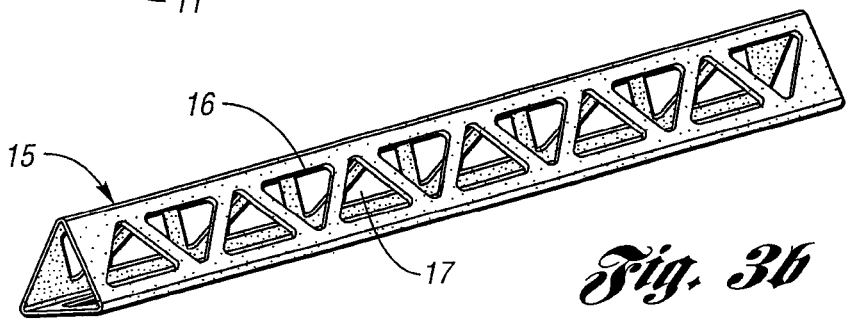

In FIG. 2 is shown another preferred embodiment wherein mat 2 of wood fibers 3 and containing flocculant particles 4 is wound around a non-removable mandrel 6, constructed of compressed and binder bound straw, as depicted in FIG. 3*b*.

While the preferred products are described as having a hollow center by virtue of being wound around a removable mandrel, it should be noted that similar products can be prepared by winding around non-removable mandrels. Such mandrels, for example, may be made of compacted organic material containing sufficient binder to provide a preferably somewhat rigid product, as described below, for example one with a diameter which is preferably between 2 and 10 cm, more preferably between 2 and 6 cm. Most preferably, such mandrels, when used, are of organic and biodegradable material, such as compressed compost, peat, grass straw, wood fiber, etc., preferably with a decomposable binder as well. The stiffness of the non-removable mandrels need only be such so as to allow the planar mat to be rolled around the mandrel. Thus, the mandrels need not be self supporting. To render the mandrels more flexible, they may be cut partially through at intervals, or may be molded with repeating notches, etc.

Further examples of mandrels are mandrels molded of synthetic or natural materials, or combinations thereof. In preferred embodiments, such mandrels are hollow and include numerous openings in the walls thereof, so that water may flow through these openings. Examples of wholly synthetic mandrels of this type include round plastic tubes perforated with holes, stiff, circular cross-section polymer mesh, etc. In a particularly preferred embodiment, the mandrel will be a hollow mandrel of triangular cross-section, made of plastic mesh. Alternatively, such mesh-like or other mandrels may be made of biopolymers or from other biodegradable compositions such as starch products similar to those used to make starch-based stakes. The mandrels may also be made of corrugated paper, cardboard, and the like, which may be stapled, tied, or adhesively bonded, for example using a conventional white or yellow glue, phenol-formaldehyde resin, melamine/formaldehyde resin, etc. The binder may also be a water absorbant polymer or flocculant polymer.

In one preferred embodiment, the fiber filtration tube takes the form of a triangle. A triangular, plastic mesh mandrel is employed, in the most preferred embodiment as a substantially equilateral triangle having sides measuring about 12-16 inches in length. When mat is wrapped around this relatively large, non-removable mandrel, a unique product is obtained which has a gravitationally stable base, and a height which can meet various government requirements for height, all without being unduly heavy. Height, for example may be in the range of 18 inches from ground surface as installed. This embodiment, like the others described herein, can be used without flocculant if desired.

Examples of non-removable mandrels are shown in FIGS. 3*a* and 3*b*. In FIG. 3*a*, the mandrel 10 is composed of binder-bound wood fibers 12, in this case with notches 11 which go part way through the mandrel 10 to provide flexibility. In FIG. 3*b*, the mandrel 15 is made of thermoplastic 16, having holes along its length.

Figure 4:
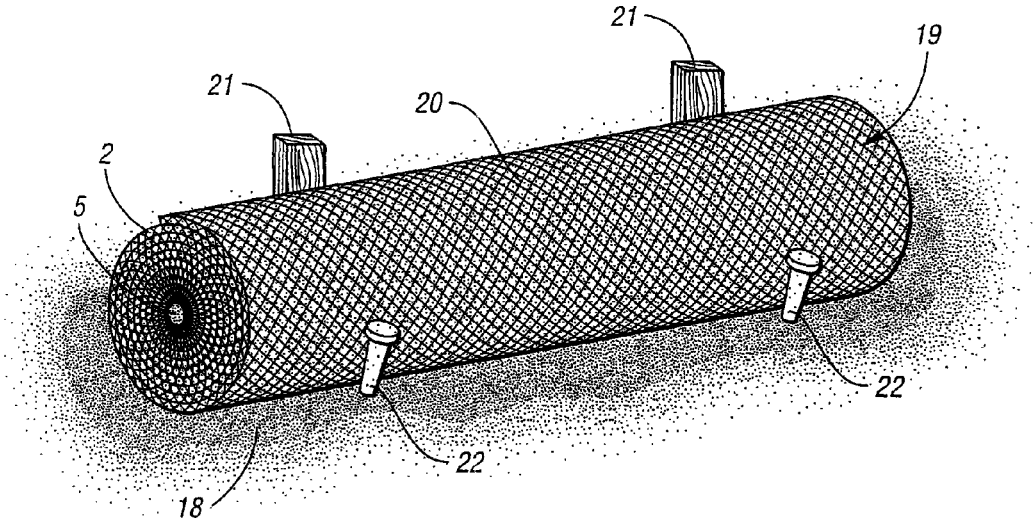
FIG. 4 illustrates a preferred embodiment of a net sheathed fiber filtration tube emplaced on soil by wooden stakes.

FIG. 4 illustrates a preferred filtration tube 19 with hollow central portion 5 (prepared by winding mat 2 about a removable mandrel), secured in place on earth 18 secured by wood stakes 21 and starch stakes 22. The tube's integrity is increased by encasing the rolled mat within polymer netting 20.

Thus, in general, when removable mandrels are used, which is preferred, the fiber filtration tubes will contain a central void caused by removal of the mandrel, while when a non-removable mandrel is employed, the central area of the tubes will contain an element which is of different construction than the rolled up filtration tube outer portion. The non-removable mandrel may also contain flocculant. Both the non-removable mandrel and the void left upon the removal of a removable mandrel are termed herein a "first portion" or "inner portion," while the mat which is wrapped around the mandrel or its void may be characterized by terms such as "an outer portion," a "spirally wrapped portion" and like terms. By spirally wrapped is meant the type of reasonably concentric layers one would achieve by wrapping a planar construction about a mandrel, whether the mandrel's cross-section is round, triangular, square, ellipsoidal, or of other geometric shape. Likewise, the outer shape of the fiber filtration tube need not be circular. Triangular shapes, for example, may aid in positioning the fiber filtration tubes and may also provide greater amounts of flocculant and filtration near ground level. The fiber filtration tubes of the present invention may contain additional portions as well, for example unconsolidated fibers between the inner and outer portions, multiple fiber mat wrappings, etc. By the term "fiber filtration tube" is meant the filtration tubes described herein, useful for trapping of sediment and/or minimizing erosion. The term does not apply to filtration devices which might be used for industrial filtration, filtration in the chemical laboratory, etc. The various uses of the inventive filtration tubes may herein be termed "erosion control," regardless of their actual function in the natural environment.

It is very difficult to roll the mat product in a commercially acceptable manner without providing something to wind the mat about. Preferred embodiments of removable and non-removable mandrels have already been described. However, non-removable mandrels may also be made from a non-rolled portion of the fiber mat itself. This may be accomplished by bunching together a sufficient amount of the edge of a fiber mat so as to allow this bunched portion to serve as a mandrel around which the remainder of the mat is rolled. For automated equipment, for example, a modest length extending from the mat edge may be pleated and the pleats pushed together, where they may be temporarily or permanently secured, if desired, for example by stapling along the length. This compacted, pleated section may assume the cross-sectional shape of a square, rectangle, etc.

The fiber filtration tubes are preferably encased within a sheath of netting, which may be preformed as a tubular "sock," to serve as a structure to prevent the tube from unwinding. However, other structures may also be used, as described previously. In one preferred embodiment, staples are used to prevent unwinding. These staples may be inserted proximate the edge of the last layer of mat wound to form the filtration tube, or may be inserted several feet, for example 2-3 feet (0.6-1 m) before the edge of the last layer, such that the tube may be partially unwound to form an "apron" which may be positioned parallel to the ground. By terms such as "securing the tube from unwinding" is meant that at least a portion of the mat and preferably all or substantially all except for the apron described above, when present, is prevented from unwinding.

The benefits of the fiber filtration tubes of the present invention may be ascertained from a comparison of inventive fiber filtration tubes and commercially available tubes, and by comparison of fiber filtration tubes of identical construction in accordance with the preferred embodiments described herein, with and without flocculent.

While the fiber filtration tubes of the present invention are preferably employed in conjunction with a flocculent, as described for the preferred embodiments, even without flocculant, the fiber filtration tubes are surprisingly effective, far more effective than competitive products employing fibers such as rice straw, etc. See, e.g. Table 3, where the tube without flocculant (Example C5) was superior to other commercial products (C1 through C4), even without flocculent. In this embodiment, the roll is preferably encased in polymer netting or its equivalent, and/or in other preferred embodiments the mat of which the roll is formed is wrapped around a triangular mandrel, removable or unremovable. In use, as with the flocculant containing filtration tubes, the flocculant-free filtration tubes are positioned on the ground and staked or otherwise secured to substantially prevent unrolling. Filtration tubes encased in polymer netting or otherwise secured with a securing device such as cord, straps, staples, etc., need not necessarily be staked, but merely placed on the ground. Staking is preferred, however, with stakes or staples of steel being most preferred. The securing devices which prevent the roll from unwinding when installed in the field must allow ingress and egress of water. Thus, for example, relatively impervious wrappings such as polymer films or tightly woven polymer or other fabric which impede water flow are not suitable.

To test the fiber filtration tubes, an artificial gully (or natural gully) is newly surfaced with earth treating machinery that the tests begin with the same ground contour, slope, etc. A large tank of water (7500 lbs; 3120 Kg) containing 450 pounds (185 Kg) of fine sediment is positioned at the head of the gully, and the products under test are positioned transversely across the gully, with ends extending beyond the expected pooling of water behind the products, and secured by metal or wood stakes. Water is then released to simulate a high degree of runoff, and samples are collected at 5 minute intervals and analyzed.

The products tested are described as follows. Examples prefixed by a "C" are comparative examples.

Example C1: Sediment Stop™, a product of North American Green

Example C2: Curlex Sediment Log™, a product of American Excelsior

Example C3: Compost Sock, a product of Filtrexx International

Example C4: Straw Wattles, a product of Earth Savers

Example 5: TerraTube™, a soon to be commercialized product of Profile Products, Inc., with flocculant Example C6: TerraTube™, a product of Profile Products, Inc., similar to Example 5, but without polyacrylamide flocculant.

Preparation of Mandrel-Wound Fiber Filtration Tubes

EXAMPLE 1

A netless fiber mulch mat product is prepared by admixing in an air stream, 93 parts by weight of wood fibers prepared from pine and/or mixed wood species, 35% of which collect on a #8 sieve, and having an average length of about 0.75 inches (Profile Products thermally refined wood fiber), and 7% of synthetic fibers. The synthetic fibers constitute about 15% bicomponent staple fibers having a length of 2 inches (5 cm) and a polyester core and polyethylene sheath, available from Leigh Fibers, and about 85% polypropylene staple fibers, 1.5 inches average length, from Synthetic Industries, supplied separately. The fibers are deposited on a moving fiberglass belt of 84 inch (2.13 m) width in a thickness of about 0.62 inch and at a minimal width of about 82 inches and are preliminarily heated under a set of radiant panels which provide a strong surface bond to the bicomponent and polypropylene fibers, and then pass through two heated rollers having a length of 100 inches and diameter of 18 inches, both rollers heated to a surface temperature of 300° F. (149° C.), maintained at a spacing of approximately 0.75 to 1 mm. The mat passes through the rollers at a lineal speed of approximately 80 to 120 ft/min. The mat is consolidated to a mulch mat product which is drapeable but yet which exhibits good tensile and tear strength.

EXAMPLE 2

In a manner similar to Example 1, a product is prepared from a batt of 91% classified pine wood fibers, 32.5-40% of which collect on a standard ASTM #8 sieve, and 9% of bicomponent fibers with a polyester core and polyolefin sheath with a sheath melting temperature of 110° C., average lengths between 2-3 inches (5-7.6 cm), and a denier of 15. The batt is consolidated as in Example 1 to a finished product which has a nominal areal weight of 0.29 lbs/yd$^2$ (110 g/m$^2$).

Prior to consolidation, the mat, slightly greater than ⅜ inch (9.5 mm) in thickness, is heated by radiant heating. The batt surface temperature is initially becomes 275° F. (135° C.) and as the batt traverses below the radiant heat panels, the temperature increases to about 420° F. (216° C.) at the end of the heating cycle. No heat is applied for about 4 seconds as the traveling batt continues towards the consolidating rollers. The rollers are maintained a distance apart so as to produce modest compression and to obtain a product, after spring-back following compression, of about ⅜" (9.5 mm). The bottom roller is maintained at 300° F. (149° C.), while the top roller is maintained at 325° F. (163° C.). Following exit from the rollers, the product is allowed to cool.

Both the mats of Example 1 and Example 2 are suitable for preparing the fiber filtration tubes of the present invention, although other mats are suitable as well.

EXAMPLE 5

The mat prepared in accordance with Example 2 is wound around a removable mandrel which is rod-like in shape with a diameter of 2.5 inches (6.4 cm). Prior to the mat being rolled around the mandrel, the surface of the mat is sprinkled with polyacrylamide copolymer flocculant in an amount of 0.0055 lbs/yd$^2$ (2.9 g/m$^2$). The mat is continued to be wound around the mandrel until a nominal diameter of 9 inches (22.9 cm) is achieved. The roll is then inserted into a steel forming tube of approximately the same diameter, and the mandrel removed, leaving a central void. A further roll is prepared in the same manner, its end face coated with hot melt adhesive, and immediately inserted into the forming tube, abutting the roll resident in the tube and bonding thereto. A further roll is inserted and bonded in the same manner, each new roll pushing the resident rolls out the far end of the forming tube and within a preformed polymer netting which sheaths the rolls, forming the finished filtration tube. The end is cut to length and the netting secured at both ends. The fiber filtration tubes are preferably about 13 feet (3.9 m) in length, however other sizes are also suitable, i.e. a 6 inch (15 cm) tube in a 32.5 foot (10 m) length, and 9 inch (22.9 cm) tube in a 6.5 foot (2 m) length.

Figure 5:
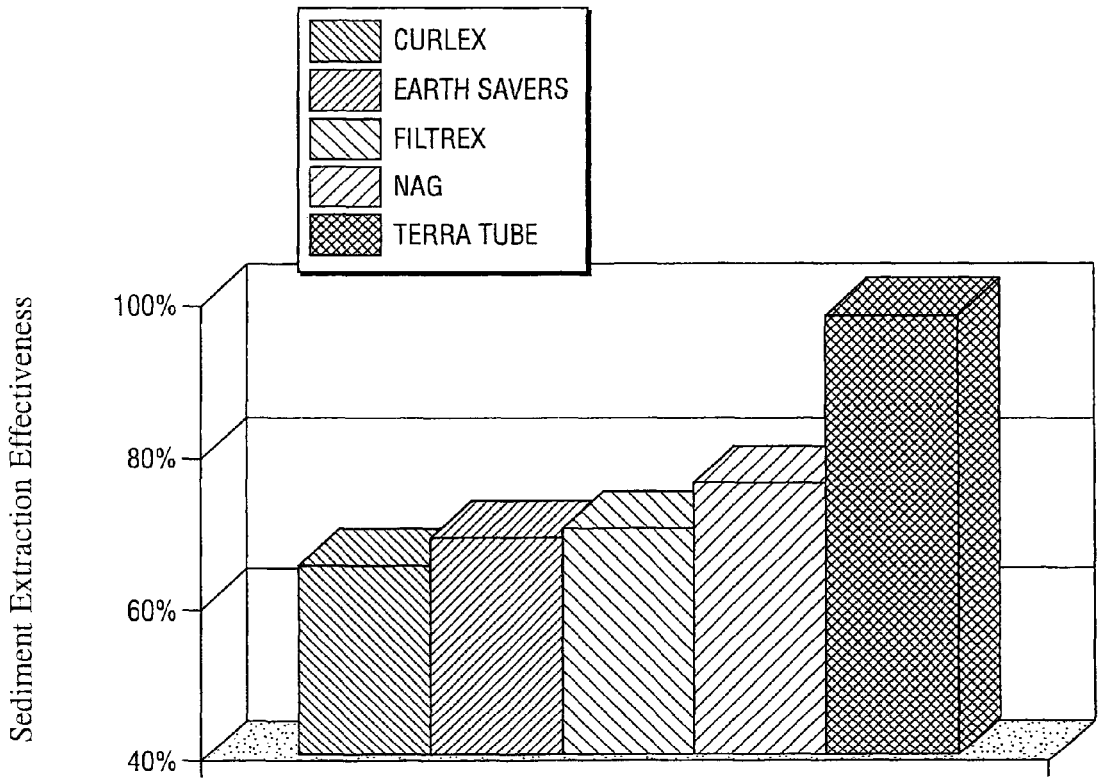
FIGS. 5-7 illustrate results of field testing of inventive and comparative products.
Figure 6:
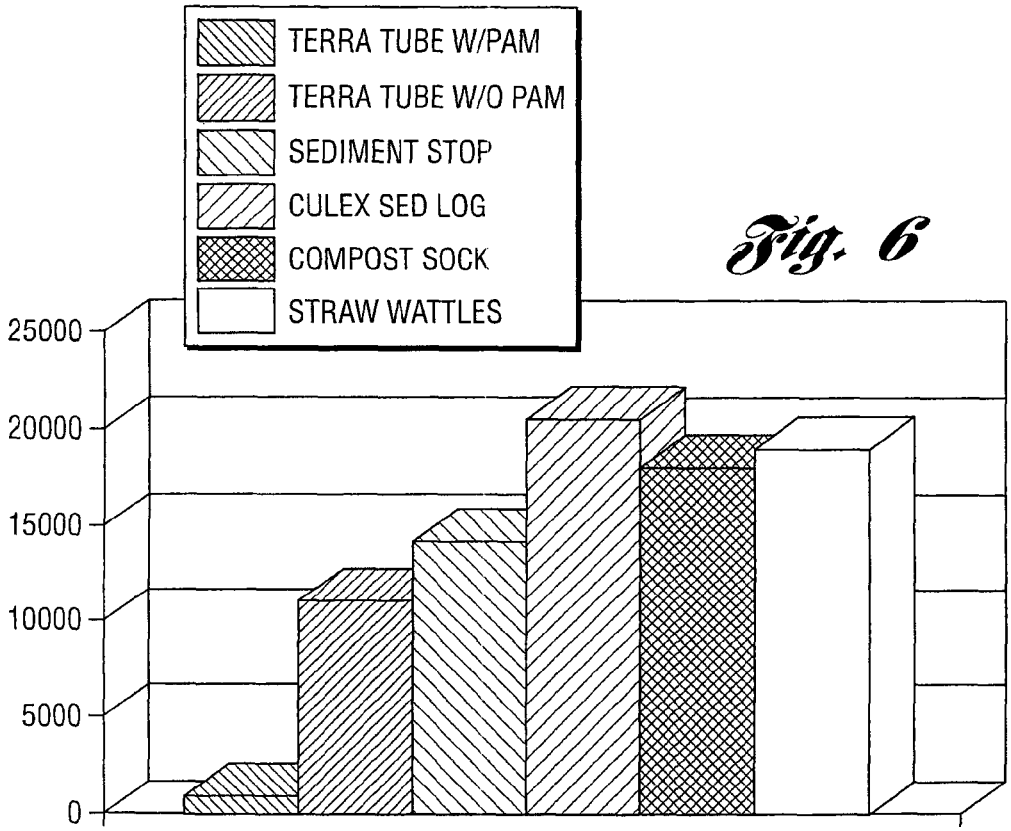
Figure 7:
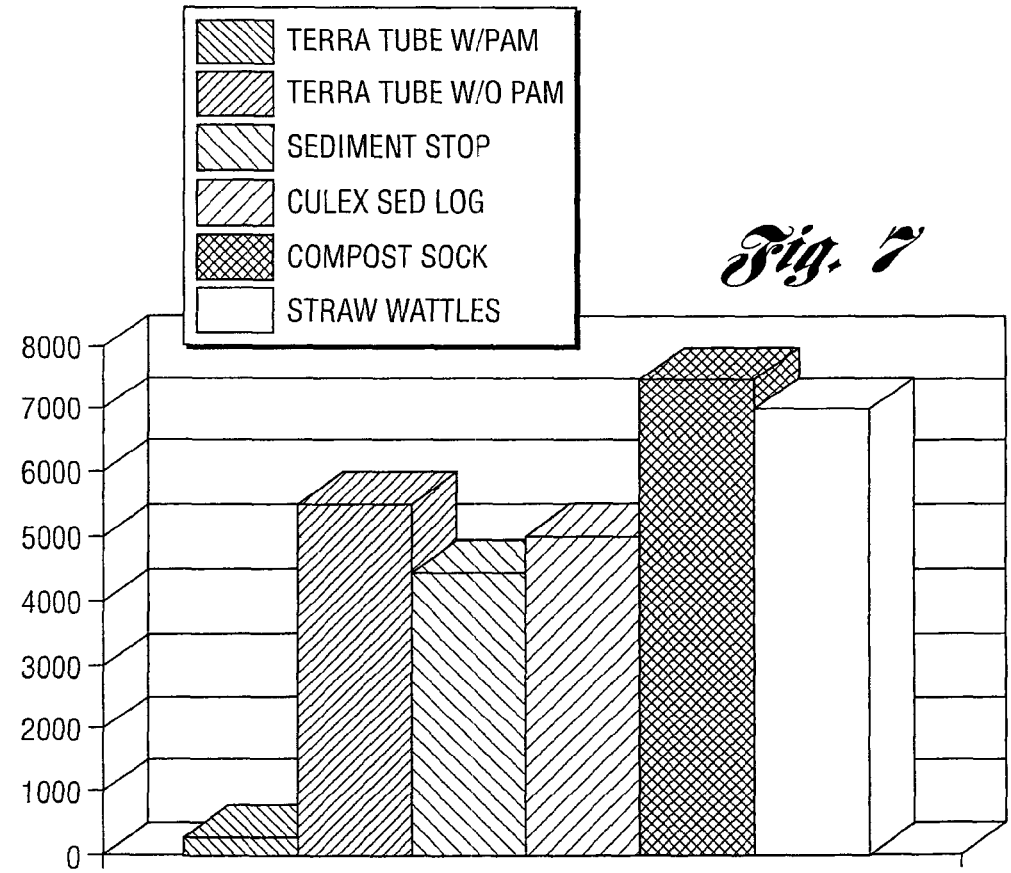

The results of the sedimentation tests are summarized by FIGS. 5-7. In FIG. 5, effectiveness is reported as sediment extraction percent effectiveness versus control (no logs or wattles). As expected, even simple straw wattles (C4) exhibited a considerable improvement in sediment extraction. However, commercially available "filtration tubes" expressly designed for sediment extraction did little better, and in one case, worse. The TerraTube product without flocculant fared the best of these non-inventive tubes, with an 81.7% sediment extraction percentage. Tabular results are printed below in Table 3.

TABLE 3

| Product of Example | Sediment Extraction % versus Control |
|---|---|
| C1 | 75.9% |
| C2 | 65.0% |
| C3 | 69.7% |
| C4 | 68.17% |
| 5 | 98.4% |
| C5 | 81.7% |

As can be seen from comparing Examples C5 and 5, the presence of flocculant in Example 5 increased the % of sedimentation to above 98% from the 81.7% effectiveness of the same type of product, but without flocculant.

Total suspended solids are illustrated in FIG. 6 and Table 4 below. Total suspended solids are reported in g/L of runoff water. Values are rounded to 3 digits.

TABLE 4

| Example | Total Runoff, mg/L |
|---|---|
| C1 | 14.3 |
| C2 | 20.6 |
| C3 | 18.2 |
| C4 | 19.1 |
| 5 | 0.933 |
| C5 | 11.0 |

As can be seen, the TerraTube product without flocculent (Comparative Example C5) was better than the other commercial products tested. However, with flocculent, the suspended solids (Example 5) decreased by a full order of magnitude (×0.1).

FIG. 7 and Table 5 illustrate water runoff turbidity in nephalometric turbidity units (NTU) at 45 minutes into the test.

TABLE 5

| Example | Turbidity, NTUs |
|---|---|
| C1 | 4500 |
| C2 | 5000 |
| C3 | 7500 |
| C4 | 7000 |
| 5 | 300 |
| C5 | 5500 |

Table 5 and FIG. 7 again illustrate greater than a 10 fold improvement over the same product with and without flocculant (Example 5 and Comparative Example C5, respectively), and various commercial products.

Total sediment loss of the various products is reported in Table 6 below.

TABLE 6

| Sediment Loss in Pounds per Acre Inch of Water Runoff | |
|---|---|
| Product of Example | Sediment Loss (lb/acre-inch) |
| C1 | 3,227 |
| C2 | 4,654 |
| C3 | 4,118 |
| C4 | 4,323 |
| 5 | 211 |
| C5 | 2491 |

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A fiber filtration tube suitable for use in erosion control, having a cross-section and a length, said fiber filtration tube comprising an inner portion being a void left by removal of a mandrel, the inner portion located at or proximate the center of the cross-section of the fiber filtration tube;

an outer portion spirally wrapped around and directly abutting the inner portion continuously along an outer peripheral of the inner portion, the outer portion including, prior to wrapping, a mat of natural fibers; and a flocculant.

2. The fiber filtration tube of claim 1, wherein the mat of natural fibers includes natural fibers and a consolidating binder.

3. The fiber filtration tube of claim 2, wherein the consolidating binder includes thermoplastic fibers.

4. The fiber filtration tube of claim 2, wherein the natural fibers include wood fibers.

5. The fiber filtration tube of claim 1, wherein the flocculant includes a soluble polyacrylamide homopolymer or copolymer.

6. The fiber filtration tube of claim 1, further comprising a sheath of polymer netting surrounding the outer portion.

7. The fiber filtration tube of claim 1, wherein the mat of natural fibers further includes bicomponent thermoplastic fibers, as a consolidating binder.

8. The fiber filtration tube of claim 1, further comprising a structure for preventing the outer portion of the fiber filtration tube from unwinding.

9. The fiber filtration tube of claim 8, wherein the planar mat includes natural fibers and thermoplastic fibers as a binder.

10. The fiber filtration tube of claim 8, wherein the outer portion includes a mat of 80% by weight or more wood fibers, and thermoplastic fibers, the thermoplastic fibers being present in an amount of less than 20 weight percent.

11. The fiber filtration tube of claim 10, wherein the thermoplastic fibers are bicomponent fibers.

12. The fiber filtration tube of claim 8, wherein the structure includes a sheath of netting.

13. A fiber filtration tube, comprising a plurality of fiber filtration tubes of claim 8, adhesively bonded end-to-end and encompassed in a sheath of netting.

14. A fiber filtration tube, comprising a plurality of fiber filtration tubes of claim 1, adhesively bonded end-to-end and encompassed in a sheath of netting.

15. The fiber filtration tube of claim 1, wherein the mat of natural fibers includes wood fibers having a mean length of from 2 mm to 25 mm.

16. The fiber filtration mat of claim 1, wherein the mat of natural fibers includes wood fibers prepared thermo-mechanically.

17. A process for the preparation of a fiber filtration tube of claim 1, comprising a) providing a mandrel;

b) winding around the mandrel a plurality of layers of a mat including natural fibers to form a fiber filtration tube;

c) supplying a flocculant in or on the mat;

d) securing the fiber filtration tube from unwinding; and e) leaving in the mandrel if the mandrel is formed of biodegradable material, or removing the mandrel to form a void such that the mat directly abuts the void continuously along an outer peripheral of the void;

f) inserting a fiber filtration tube into a forming tube;

g) preparing a subsequent fiber filtration tube;

h) applying an adhesive to at least one of the fiber filtration tube inserted within the forming tool or to the subsequent fiber filtration tube; and i) inserting the subsequent fiber filtration tube into the forming tube such that the ends of the fiber filtration tube within the forming tube and the subsequent fiber filtration tube inserted into the forming tube become adhesively bonded end-to-end.

18. The process of claim 17, wherein the mat-includes a blend of wood fibers and thermoplastic fibers.

19. The process of claim 17, further comprising inserting the fiber filtration tube into a sheath of netting.

* * * * *